US007320625B2

(12) United States Patent
Mundry et al.

(10) Patent No.: US 7,320,625 B2
(45) Date of Patent: Jan. 22, 2008

(54) CONTROL DEVICE FOR ELECTROHYDRAULIC SUPPORT CONTROLLER

(75) Inventors: Sebastian M. Mundry, Lüdinghausen (DE); Jürgen Tschöpe, Selm (DE); Wilfried Weigel, Werne (DE); Johannes Wesselmann, Dortmund (DE); Jochen Mattern, Gladbeck (DE); Keith O'Neil, McDonald, PA (US)

(73) Assignee: DBT GmbH (DE)

( * ) Notice: Subject to any disclaimer, the term of this patent is extended or adjusted under 35 U.S.C. 154(b) by 248 days.

(21) Appl. No.: 11/189,942

(22) Filed: Jul. 25, 2005

(65) Prior Publication Data

US 2006/0264118 A1 Nov. 23, 2006

(30) Foreign Application Priority Data

Jul. 26, 2004 (DE) ..... 10 2004 036 163

(51) Int. Cl.
*H01R 9/22* (2006.01)

(52) U.S. Cl. ..... 439/709; 439/721

(58) Field of Classification Search ..... 439/709, 439/502, 733.1, 721, 722; 137/884
See application file for complete search history.

(56) References Cited

U.S. PATENT DOCUMENTS 5,127,440 A * 7/1992 Maas et al. ..... 137/884
5,408,154 A * 4/1995 Meiser et al. ..... 310/71
6,109,979 A * 8/2000 Garnett ..... 439/709
6,662,825 B2 * 12/2003 Frank et al. ..... 137/557
7,144,280 B2 * 12/2006 Cabrera et al. ..... 439/709
2003/0194886 A1 * 10/2003 Mundry et al. ..... 439/76.1
2005/0164563 A1 * 7/2005 Schuttler et al. ..... 439/709

FOREIGN PATENT DOCUMENTS

DE 30 08 974 C2 3/1980
DE 30 17 993 A1 5/1980
DE 37 08 902 C2 3/1987
DE 019751007 A1 * 5/1999

* cited by examiner

*Primary Examiner*—Michael C. Zarroli
(74) *Attorney, Agent, or Firm*—Baker & McKenzie LLP

(57) ABSTRACT

A control device for electrohydrualic support controllers, with an electronic individual controller including a plug board that contains first connecting pieces, a terminal block that is mounted to a corresponding support frame and includes recesses for holding second connecting pieces, plug-in connectors for connecting cables for communicating with adjacent controllers, and at least one external power supply. A connecting plug, to which the lamp can be connected with its connecting cable, is attached to the terminal block.

16 Claims, 2 Drawing Sheets

CONTROL DEVICE FOR ELECTROHYDRAULIC SUPPORT CONTROLLER

CROSS-REFERENCE TO RELATED APPLICATIONS

This application claims priority to German Patent Application No. 10 2004 036 163.0 filed on Jul. 26, 2004.

BACKGROUND OF THE INVENTION

The invention relates to a control device for electrohydraulic support controllers, with an electronic individual controller comprising a plug board that contains first connecting pieces, with a terminal block that is mounted to the corresponding support frame, comprises recesses for holding second connecting pieces, which are arranged on the ends of the connecting cables of actuators or sensors, and is designed as a connecting unit for simultaneously connecting the first and second connecting pieces, with plug-in connectors for connecting cables for communicating with adjacent controllers, and with at least one intrinsically safe power supply that is located externally with respect to the individual controllers.

In underground mining, a variety of support frames arranged next to each other are required in longwall mining operations to keep the mining space clear for the extracting equipment. Each support frame of the longwall mining operation is assigned an individual controller, which contains the microelectronics for activating and monitoring the electrohydraulic functions of the shield support frame protected in a sturdy housing. Among the electrohydraulic support controllers used in practice, the individual controllers vary from one manufacturer to the next with respect to their hardware and application possibilities.

To enable at least repairs and effortless retrofitting and/or upgrading of the individual controllers to new hardware or software, the applicant suggested, in DE 37 08 902 02, mounting a terminal block on the shield support frame, into which all connecting cables of the sensors or actuators can be plugged with their connecting pieces, and into which plugs for the communication cables for communicating with adjacent controllers as well as for the supply of power through external power supply units can also be plugged. The back side of the individual controller is equipped with a plug board, the respective connecting pieces of which have been adapted to the arrangement of the connecting pieces in the terminal block so as to establish all plug-in connections among the connecting pieces simultaneously, by coupling the plug board to the terminal block, and integrate the respective individual controller in the underground longwall controller, support controller and powerpower supply. Due to the risk of explosion present at the longwall face, the first intrinsically safe power supply units are only sufficient for the intrinsically safe power supply of a group of for example 8 support frames, resulting in the presence of several first intrinsically safe power supply units in the longwall face.

For safety and functionality reasons, every shield support frame is equipped with a separate lamp. In presently existing control devices for electrohydraulic support controllers, the respective lamps are supplied with the necessary electric power via a separate line system, wherein the power for the lamps comes from a separate second power supply unit, while the power supply of the individual controllers is provided by the first power supply units. It has however already been suggested in the state of the art to combine the power supply for the lamp and the individual controllers (DE 30 17 993 A1 or DE 30 08 974 C2). For this purpose, a transformer is coupled to the longwall lamp, respectively, which then ensures the power supply for the individual controllers. This principle, however, is no longer employed and instead today 4-core cables are used in underground environments for power supply and data communication for individual controllers when communicating with adjacent controllers. Two cores of these tubular cables are for bidirectional data transmission, and two further cores are for supply with 12 V direct current. The lamps are therefore supplied with powerpower by means of a separate power supply unit and a separate electric circuit.

An object of the invention is to minimize wiring work in underground control devices and at the same time maintain the proven and tested concept in underground mining of individual controllers with a plug board and terminal block mounted to the shield support frame and coupled to the plug board.

BRIEF SUMMARY OF THE INVENTION

This objective is achieved by the invention recited in claim 1. According to the invention, the terminal block comprises an additional fastener that holds an attached connecting plug, to which a complementary connecting plug of a lamp can be connected for electrically connecting the lamp to the intrinsically safe power supply. According to the invention the power for the lamps and the individual controllers is distributed via a terminal block that has been modified with respect to the prior art, wherein a current-conducting connecting plug is disposed in an additional bore in said terminal block. The terminal block according to the invention is preferably designed particularly such that it comprises a front, to which the plug board of the individual controller can be coupled while simultaneously establishing the plug-in connection of all connecting pieces, the connecting plug being arranged on the back of the terminal block. Thus the individual controller is coupled to the terminal block at the front of the terminal block, while the lamp is connected to the corresponding connecting plug incorporated on the terminal block from the back.

Alternatively or additionally, in one embodiment, in which the terminal block comprises a front for coupling the individual controller to the plug board, one or preferably two connectors can be arranged in additional fasteners at the back or on lateral sides of the terminal block. These connectors, which are disposed particularly at the back of the terminal block, serve to connect the tubular cables for communicating with adjacent controllers, and in a design comprising two connectors it is particularly advantageous that the connecting plug for the lamp be supplied with power at all time if at least one of the two tubular cables is connected to one of the connectors. Moreover, a connecting piece is preferably firmly attached in one of the recesses in the terminal block for each connector, the contact pins of said connector and the corresponding connecting piece being connected via cores, which are disposed in a connecting channel in the terminal block. Consequently, this embodiment allows the individual controller to be electrically connected, at the back thereof via a connecting piece in the plug board and a corresponding connecting piece in the terminal block, to the cable that is coupled to a connector on the terminal block, the signal and/or power being forwarded via shielded cores in a connecting channel, which is provided in the terminal block. This connecting channel preferably comprises a recess, which is open towards the edge, in the back of the terminal block, the connecting channel comprising an opening for the recess of the corresponding connecting piece for the internal wiring. For underground applications, the connecting channel and the openings are preferably filled with a sealing compound after inserting and wiring all lines.

In the control device according to the invention, the power supply to the lamp and the individual controllers can be implemented in two ways. First, as has been the case until now, it is possible to provide a first power supply unit for supplying the individual controller with power and a second power supply unit for supplying the lamps with power. In a preferred embodiment, however, the same power supply unit is provided for the power supply to the individual controllers and the power supply to the lamps. This can be accomplished particularly easily when the connectors comprise more contact pins than the connecting pieces for the sensors or actuators or the connecting plugs for the lamp. Since, in underground mining, typically the connecting pieces for the actuators and the sensors are implemented as so-called SKK24 plugs and are equipped with four contact terminals, namely two contact pins and two contact bushings, it is especially advantageous to likewise equip the connecting plug for the lamp with four contact pins and/or design it as an SKK24 plug. It is particularly preferred that the connector, to which the tubular cables for communicating with adjacent controllers are coupled, be equipped with six or eight contact pins. As a matter of course, the tubular cables for communicating with adjacent controllers must also accordingly comprise a separate core for each contact pin, meaning 6 or 8 cores in total. The design according to the invention involving connectors, which comprise more contact terminals than the connecting pieces, allows at least one contact pin of the connecting plug for the lamp to be connected directly to a current-conducting contact pin of the connector. The current-conducting core can also have a larger core cross-section than the remaining ones.

The field of application for the control device according to the invention can be expanded further by disposing an isolating coupler in a chamber in the terminal block and connecting it in series between a connecting piece of the terminal block and the connecting plug for the lamp, so as to enable actuation of the lamp via the individual controller. The hardware and software present in the individual controller would then, for example, also allow the function of the lamp, including the brightness of the lamp, to be selected.

Furthermore it is particularly advantageous that two connectors be disposed in each terminal block and two connectors, respectively, in terminal blocks mounted on shield support frames and disposed adjacent to each other, are connected via cables, particularly tubular cables comprising at least six cores, of which two serve for data transmission, two as neutral conductors (ground) and two as current conductors, one current conductor being connected to the contact pin of a connecting piece mounted to the terminal block and one current conductor being connected directly to the contact pins of the connecting plug. This design supplies all lamps at the longwall face with power as soon as the tubular cables for communicating with adjacent controllers have been connected to the corresponding connectors. Additionally, the right adjacent individual controller is preferably connected via the right connector, and the left adjacent individual controller via the left connector, the bi-directional communication between the adjacent individual controllers and the central individual controller being achieved via a connecting piece in the terminal block, respectively, which is wired to the corresponding connector. The central individual controller by contrast is supplied with electricity preferably by only one of the two connectors.

BRIEF DESCRIPTION OF THE SEVERAL VIEWS OF THE DRAWINGS

The invention will be explained in more detail hereinafter with reference to the embodiments that are schematically illustrated in the figures, wherein.

DETAILED DESCRIPTION OF THE INVENTION

In underground longwall operations, a longwall extraction face is held open in the area of the extraction face and the underground extracting equipment by means of electrohydraulically operated shield support frames. To be able to coordinate the functions of each shield support frame and coordinate the entire face on shield support frames, each shield support frame contains an individual controller comprising the hardware and software required for control functions. All individual controllers are connected among each other via cables for communicating with adjacent controllers, and furthermore each separate individual controller is connected to the corresponding actuators and sensors of the shield support frame. In a control device for electrohydraulic support controllers, it must be ensured at the same time that each individual controller is supplied with power, can exchange data with adjacent individual controllers and can transmit the control commands to the allocated actuators as well as receive measurement readings from sensors. Moreover, each shield support frame comprises a lamp for illuminating the underground longwall face, for example for the miner.

Figure 1:
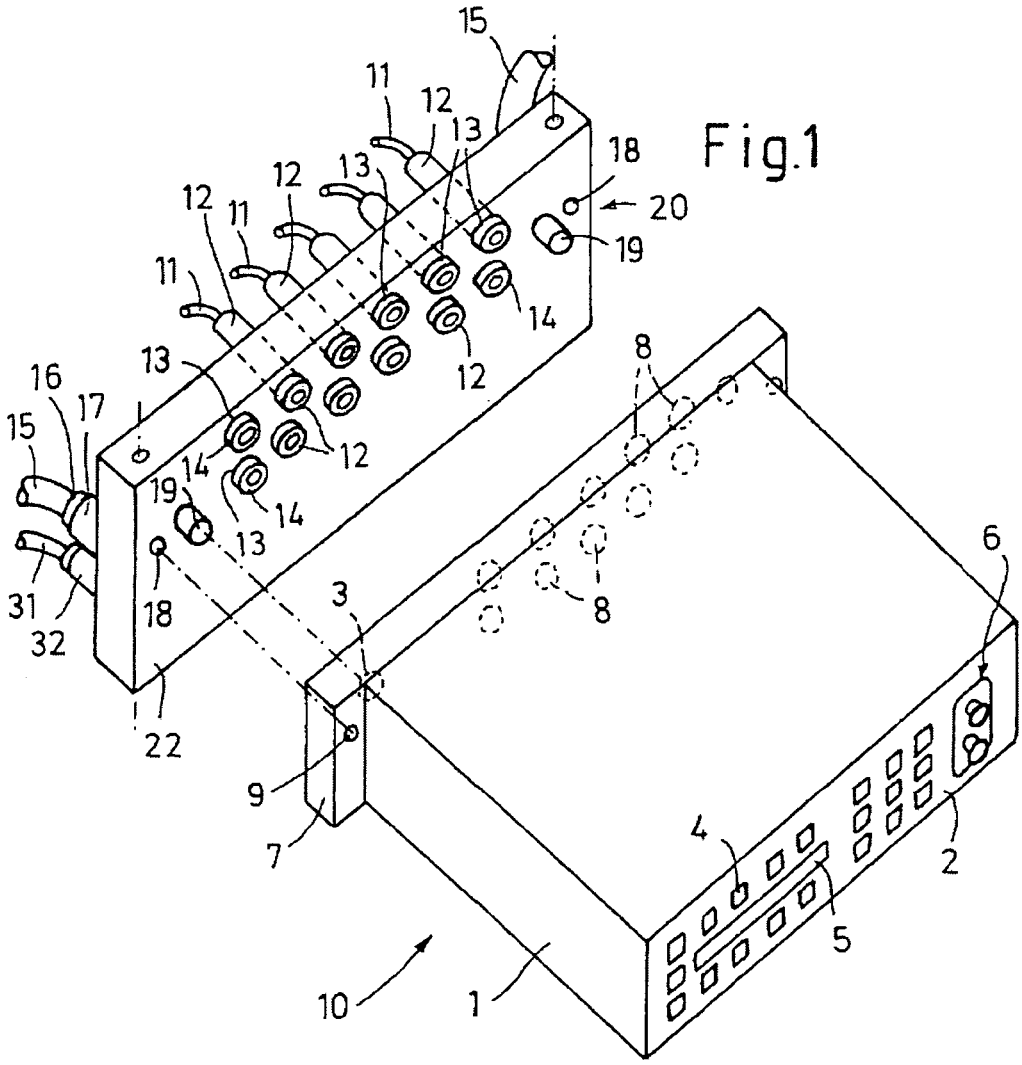
FIG. 1 is an exploded simplified perspective view of a terminal block that can be attached to a shield support frame and to which individual controllers can be connected.

In the figures, an arbitrary individual controller with respect to its internal hardware and software has been designated by reference numeral 10, which, as FIG. 1 illustrates, comprises a housing 1 having the shape of a shallow box, which houses all of the microelectronics for performing the control functions so as to be protected against exterior ambient influences in a sealed fashion. A control panel, which further comprises, in this case, a display strip 5 in addition to several function keys 4, is disposed on a front 2 of the individual controller 1 so as to allow the miner to monitor and possibly influence the respectively assumed functions of the shield support frame (not shown) on which the individual controller 10 is mounted. Furthermore, at the front 2 two push buttons, both designated by reference numeral 6, are disposed, one push button serving as emergency shut-off button and the other push button being for locking the allocated support frame, as is well known in underground mining.

At the back of the housing 1, the individual controller 10 comprises a plug board 7, which in the illustrated example is equipped with a total of twelve connecting pieces 8 designed here as female plugs, which are arranged in two rows of six plugs each, and which can be electrically connected to the connecting cables 11 of actuators or sensors by coupling the plug board 7 to a terminal block 20 that is mounted on the shield support frame. At an end thereof, each connecting cable 11 is equipped with a connecting piece 12, which is designed particularly as an SKK24 plug and comprises four contact terminals for connecting four contact cores of the cable 11 to a complementary connecting piece 8 on the plug board 7 of the individual controller 10. Each connecting piece 12 on the cables 11 engages in a recess 13 in the terminal block 20 and is anchored there by means of U-shaped clamps, which are not shown. In the illustrated example of the terminal block 20, nine of the twelve recesses 13 are implemented as through holes, and the connecting pieces 12 anchored in the terminal block 20 project beyond the front 22 of the terminal block 20, allowing them to engage in the allocated connecting pieces 8 on the plug board 7. Meanwhile, in three recesses 13 of the terminal block 20, connecting pieces 14 are firmly mounted, which in turn can engage in connecting pieces 8 in the plug board 7 of the individual controller 10 and are designed to be substantially identical to the connecting pieces 12. One of the connecting pieces 14 mounted to the terminal block 20, respectively, is connected via a connector 17 at the back 21 of the terminal block 20 to the cores of a tubular cable 15 comprising a complementary connector 16 at an end thereof for communicating with adjacent controllers, as explained in further detail below. In the illustrated example, the connector 17 is equipped with a socket.

The individual controller 10 with the plug board 7 is attached to the terminal block 20 located on the support frame by means of fastening screws, which extend through bores 9 aligned with each other in the plug board 7 and 18 of the terminal block 20. Centering of the plug board 7 relative to the terminal block 20 occurs by means of centering studs 19, which are embedded in centering stud recesses 19A (FIGS. 3 and 5) in the terminal block 20 and engage in allocated centering recesses 3 in the plug board 7.

Figure 2:
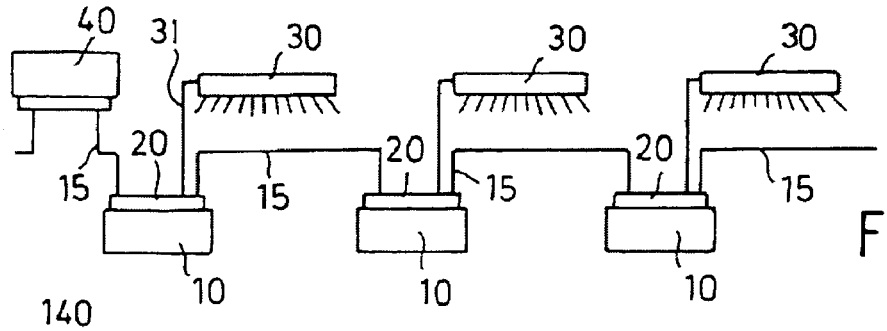
FIG. 2 is a control device according to a first exemplary embodiment of the invention.

FIG. 2 shows three individual controllers 10 of a control device according to the invention, each being allocated to a support frame, which is not shown in detail. As already explained above, each individual controller 10 is coupled detachably to a terminal block 20, which is firmly mounted to the shield support frame. FIG. 2 furthermore depicts the lamps designated with 30, wherein each lamp 30 is allocated to a shield support frame, as well as a 12 V power supply unit 40 for the intrinsically safe power supply of both the individual controllers 10 and the lamps 30. While the lamps 30 are supplied with electric power via the same power supply unit 40 as the individual controller 10, the electric power is distributed within the terminal block 20 such that the current for the lamps 30 is conducted through the terminal block 20 independently from the individual controllers 10, i.e. is not looped through the individual controllers 10. Each lamp 30 is therefore connected via the allocated lamp cable 31 comprising a plug for connecting to a connecting plug (32, FIG. 4), which is connected in an additional fastener 23 at the back 21 of the terminal block 20, as is illustrated particularly in FIGS. 4 and 5. Power is supplied to each individual controller 10 as well as to the corresponding connecting plug 32 on the terminal block 20 via the tubular cables 15 for communicating with adjacent controllers, respectively, the tubular cables 15 being equipped with six or preferably eight cores, of which four cores are allocated to the individual controller 10 and another two cores to the connecting plug 32 for the lamp 30. For illustration purposes reference is now made to FIG. 5. The diameter of the two connectors 17 that are firmly mounted to the terminal block 20 and serve for communication with adjacent controllers is approximately 1.5 times that of the connecting plugs 32 and that of the connecting pieces (12, FIG. 1) of the connecting cables for the sensors and actuators, these pieces extending through the recesses 13 of the terminal block 20. The connectors 17 here are preferably designed as SKK28 plugs with four contact pins 17A and four contact bushings 17B, so that each connector 17 can be coupled to a connector 16 of identical design on the tubular cable 15 such that a contact pin of one connector engages in a contact bushing of the other connector, respectively, and vice versa. The connecting plug 32 as well as the connecting pieces 14 mounted to the terminal block 20 by contrast comprise two contact pins 14A, 32A and two contact bushings 14B, 32B, respectively, which are used for power supply and communication purposes.

Figure 3:
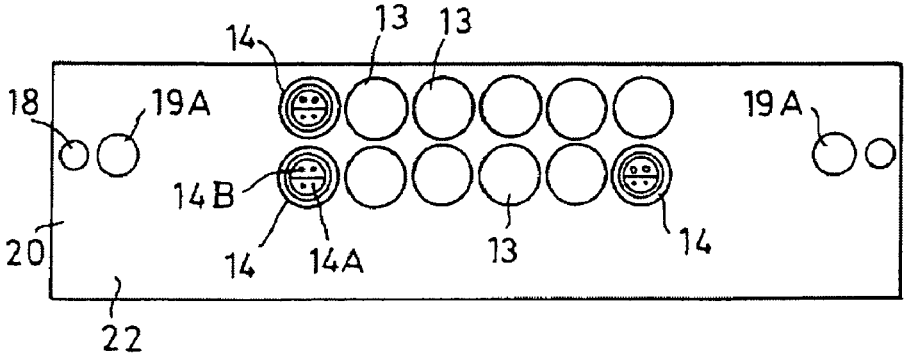
FIG. 3 is a schematic illustration of the terminal block that is used in the invention with a view of the front that can be coupled to the individual controller.
Figure 4:
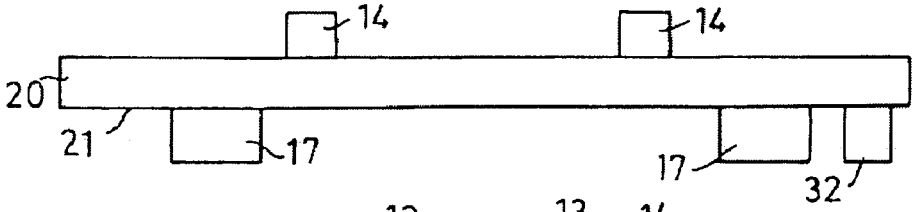
FIG. 4 is a top view of the terminal block from FIG. 3.
Figure 5:
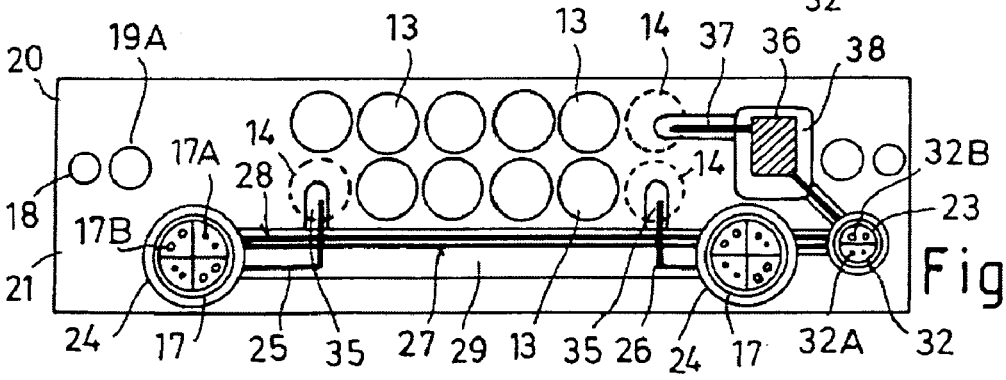
FIG. 5 is a schematic illustration of the back of the terminal block from FIG. 3.

FIGS. 3 to 5 illustrate the configuration of the terminal block 20, which is preferably made of brass and is shown without the cable inserted in the fastener 13 comprising the connecting pieces. FIGS. 3 to 5 show only the pre-assembled connecting pieces 14, the connecting plug 32 for the lamp and the two connectors 17 for communicating with adjacent controllers. From the view of the front 22 of the terminal block 20 in FIG. 4 it is apparent that three contact plugs 14 have already been inserted in recesses of the terminal block, while the remaining nine recesses 13 are still available for holding the connecting pieces of the actuator and sensor cables. The contact pins 14A and contact bushings 14B of the two outer connecting pieces 14 in the lower row of recesses 13 are electrically connected via the 4-core lines 25, 26 illustrated in FIG. 6 to a contact pin 17A or a contact bushing 17B, respectively, in the connector 17. The tubular cable 15 for communicating with adjacent controllers can therefore be connected at the back 21 of the terminal block 20, and the data transmitted via the tubular cable 15 while the transmitted power can be fed to the individual controller 10 via the connecting piece 14 when the controller is coupled to the front 22 of the terminal block 20. At the same time, at least one contact pin 17A and one contact bushing 17B, respectively, are wired on the two connectors 17 with allocated contact pins 32A and bushings 32B via the two lines 27, 28 to the connecting plug 32, and for example the 12 V voltage is applied to the line 27 and the line 28 forms the neutral conductor (ground). All lines 25, 26, 27, 28 run in the terminal block in a channel 29 that is open towards the edge at the back 21 of the block, and FIG. 5 clearly shows that those recesses, in which the firmly mounted connecting pieces 14 are disposed, are not implemented as through holes, but instead only as depressions with openings 35 towards the channel 29. All the wiring of the firmly mounted connecting piece 14, the connecting plug 23 for the lamp and the connector 17 for communicating with adjacent controllers can therefore be routed in a protected fashion within the terminal block 20, the supply channel and the openings including the routed lines and open electrical contacts being filled with a sealing compound (not shown) for further protection. The connector 17 is wired to the connecting plug 32 via the lines 27, 28 such that the corresponding contact pins in the connectors 17 are short-circuited with respect to the power transmission for the lamps.

In an exemplary embodiment according to the invention not only are the lamps 30 supplied with power via distribution in the terminal block 23, but the lamps 30 can also be actuated by means of the individual controller 10, for example be dimmed, flashed or the like. Signal transmission from the individual controller 10 to the connecting plug 32 and the lamp connected thereto occurs via a connecting piece 14, which is firmly mounted in the terminal block 20 and disposed in the top row of the recesses 13. For safety approval reasons, an isolating coupler 36 is connected in series via lines 37 between the connecting plug 32 and the corresponding connecting piece 14 that can be coupled to a connecting piece in the individual controller 10. The isolating coupler 36 is disposed in a protected fashion in a recess 38 at the back 22 of the terminal block 20.

Figure 6:
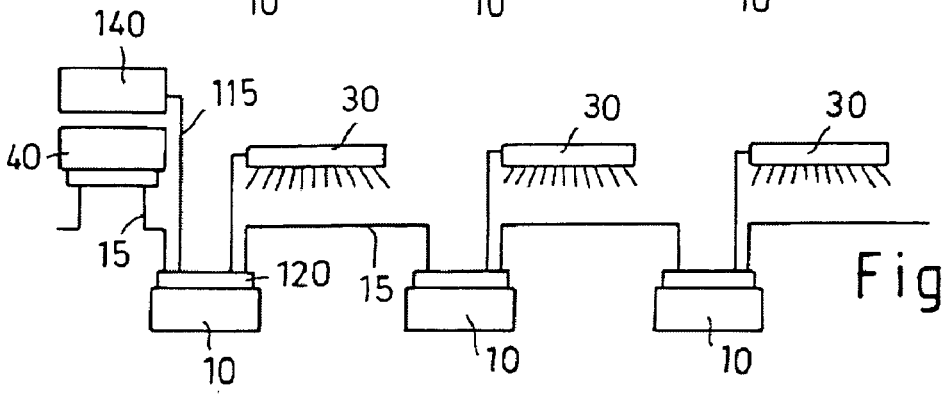
FIG. 6 is a view of a control device according to a second exemplary embodiment.

In the exemplary embodiment according to FIGS. 1 to 5, the same power supply unit 40 is used both for supplying power to the individual controllers 10 and for supplying power to the lamp 30. FIG. 6 depicts an alternative embodiment where a second, separate power supply unit 140 is provided for power supply to the lamps 30. In the example according to FIG. 6, consequently the individual controllers 10 are supplied with power by the intrinsically safe power supply unit 40 and the lamps 30 are supplied by the power supply unit 140. The supply and distribution of power in turn can take place as in the previous example via the tubular cables 15 for communicating with adjacent controllers. The electric current of the separate power supply unit 140, however, is coupled into an additional plug on the terminal block 120 via a separate current-conducting cable 115. Here as well, all tubular cables 15, which connect two terminal blocks 120 directly with each other, can be implemented with eight individual cores, wherein those cores serving for the power supply to the lamps 30 can be designed to have a larger cross-section than the remaining cores.

Those skilled in the art will understand that numerous modifications can be made to that described above, without departing from the scope of the appended claims. It is understood that the number of recesses and the respective recess assignments with connecting pieces can be modified randomly without departing from the scope of the appended claims. Instead of one tubular cable comprising eight individual cores also two tubular cables with four individual cores, respectively, may be used. The isolating coupler and the third connecting piece pre-mounted in the terminal block could be eliminated if the lamps are not intended to be actuated by means of the individual controllers.

The invention claimed is:

1. A control device for electrohydraulic support controllers, having an electronic individual controller comprising a plug board that comprises a plurality of first connecting pieces, with a terminal block that is mounted to a corresponding support frame, and comprises recesses for holding a plurality of second connecting pieces, which are disposed on ends of the connecting cables of actuators or sensors, having plug-in connectors for connecting cables for communicating with adjacent controllers, and having at least one external intrinsically safe power supply, characterized in that the terminal block comprises an additional fastener, which holds an attached connecting plug, to which a connecting plug of a lamp can be connected for electrically connecting the lamp to the intrinsically safe power supply.

2. The control device of claim 1, characterized in that the terminal block comprises a front to which the plug board of the individual controller can be coupled while establishing a plug-in connection between the plurality of first connecting pieces and the plurality of second connecting pieces, the connecting plug being disposed at a back of the terminal block.

3. The control device of claim 1, characterized in that the terminal block comprises a front to which the plug board of the individual controller can be coupled while establishing a plug-in connection between the plurality of first connecting pieces and the plurality of second connecting pieces, at least one connector of the plug-in connection for communicating with adjacent controllers being disposed in an additional fastener at a back or on lateral sides of the terminal block.

4. The control device of claim 3, characterized in that, in one of the recesses, a connecting piece, which can be coupled to a first connecting piece on the individual controller, is attached for each connector, contact pins and bushings of the connector and a corresponding connecting piece being connected via cores of a line running in a connecting channel of the terminal block.

5. The control device of claim 4, characterized in that the connecting channel comprises a recess that is open towards an edge at the back of the terminal block.

6. The control device of claim 5, characterized in that the connecting channel comprises at least one opening towards the recess for the corresponding connecting piece mounted to the terminal block.

7. The control device of claim 6, characterized in that the connecting channel and/or the opening are filled with sealing compound.

8. The control device of claim 1, characterized in that a first power supply unit is provided for supplying power to the individual controllers and a second power supply unit is provided for supplying power to the lamp.

9. The control device of claim 1, characterized in that a same power supply unit is provided for supplying power to the individual controllers and the lamp.

10. The control device individual controller of claim 1, characterized in that the connectors comprise more contact pins or contact bushings than the connecting pieces.

11. The control device of claim 10, characterized in that the connecting pieces and the connecting plug for the lamp are equipped with four contact pins or bushings.

12. The control device of claim 3, characterized in that the connectors are equipped with six or eight contact pins or bushings.

13. The control device of claim 12, characterized in that a contact pin or a contact bushing for the lamp is connected directly to a power-conducting contact pin or a power-conducting contact bushing of the connector by means of a core.

14. The control device of claim 1, characterized in that an isolating coupler, which is connected in series between a connecting piece in the terminal block and the connecting plug for actuating the lamp via the individual controller, is disposed in the terminal block in a chamber.

15. The control device of claim 1, characterized in that two connectors, respectively, of terminal blocks that are mounted on shield support frames arranged next to each other are connected via tubular cables comprising at least six cores, of which two are for data transmission, two serve as neutral conductors (ground) and two serve as current conductors.

16. The control device of claim 1, characterized in that a right adjacent individual controller is connected via a right connector, in that a left adjacent individual controller is connected via a left connector, and in that bi-directional communication between adjacent individual controllers and a central individual controller occurs via a connecting piece in the terminal block, the central individual controller being supplied with electricity via one of the connectors.

* * * * *